US009334102B1

(12) United States Patent
Parker

(10) Patent No.: US 9,334,102 B1
(45) Date of Patent: May 10, 2016

(54) HUNTING GAME INSULATED COOLER

(71) Applicant: Randall Blaine Parker, Mansfield, TX (US)

(72) Inventor: Randall Blaine Parker, Mansfield, TX (US)

( * ) Notice: Subject to any disclaimer, the term of this patent is extended or adjusted under 35 U.S.C. 154(b) by 0 days.

(21) Appl. No.: 13/935,901

(22) Filed: Jul. 5, 2013

Related U.S. Application Data

(60) Provisional application No. 61/668,480, filed on Jul. 6, 2012, provisional application No. 61/790,341, filed on Mar. 15, 2013.

(51) Int. Cl.
*B65D 43/26* (2006.01)
*B65D 81/38* (2006.01)
*A45C 11/20* (2006.01)

(52) U.S. Cl.
CPC ..... *B65D 81/3813* (2013.01); *A45C 11/20* (2013.01)

(58) Field of Classification Search
CPC ..... B65D 81/3813; A45C 11/20
USPC ..... 220/23.88, 254.1, 592.2, 592.23, 366.1; 206/427; 426/106; D9/425
See application file for complete search history.

(56) References Cited

U.S. PATENT DOCUMENTS

| | | | | |
|---|---|---|---|---|
| 3,643,631 | A * | 2/1972 | Wade et al. | 119/434 |
| 6,253,569 | B1 | 7/2001 | Hall | |
| 6,508,077 | B1 | 1/2003 | Vander Boegh et al. | |
| 6,510,705 | B1 | 1/2003 | Jackson | |
| 6,557,353 | B1 | 5/2003 | Fusco et al. | |
| 7,441,672 | B2 * | 10/2008 | Cadiente et al. | 220/608 |
| 7,634,919 | B2 | 12/2009 | Bernhard, Jr. et al. | |
| 7,954,503 | B2 | 6/2011 | Glass | |
| 8,123,068 | B2 | 2/2012 | Sturrock | |
| 2006/0137379 | A1 | 6/2006 | Cawthon | |
| 2008/0245793 | A1 * | 10/2008 | Hanson et al. | 220/263 |
| 2013/0112739 | A1 * | 5/2013 | Philips et al. | 229/117.27 |

* cited by examiner

*Primary Examiner* — Fenn Mathew
*Assistant Examiner* — Elizabeth Volz
(74) *Attorney, Agent, or Firm* — Anderson & Levine, L.L.P.

(57) ABSTRACT

A thermally protective storage cooler with a plurality of hardened material walls. The cooler also has at least one aperture formed in a first wall of the hardened material walls and at least two apertures formed in a second wall of the hardened material walls. In the cooler, the second wall is adjacent the first wall so that each of the at least one aperture and the at least two apertures is for receiving a respective portion of a body of game when a portion of the body of the game is stored in an interior of the cooler.

17 Claims, 6 Drawing Sheets

HUNTING GAME INSULATED COOLER

CROSS-REFERENCES TO RELATED APPLICATIONS

This application claims priority, and the benefit of the filing date, under 35 U.S.C. §119 of U.S. Provisional Application No. 61/668,480, filed Jul. 6, 2012, and which is hereby incorporated herein by reference. This application claims priority, and the benefit of the filing date, under 35 U.S.C. §119 of U.S. Provisional Application No. 61/790,341, filed Mar. 15, 2013, and which is hereby incorporated herein by reference

STATEMENT REGARDING FEDERALLY SPONSORED RESEARCH OR DEVELOPMENT

Not Applicable.

BACKGROUND OF THE INVENTION

The preferred embodiments relate to insulated coolers and more particularly to an insulated cooler for alternatively storing hunting game, such as in substantially or fully whole form, while alternatively functioning to store items comparable to that of an ordinary cooler.

Hunting, particularly in the South or at the beginning of the season when temperatures are too high to allow for outdoor hanging, necessitates the storage of the animal in a way that maintains the integrity of the meat. One of the main reasons hunters require temporary cold storage of the whole game animal, such as deer, is transportation of the game animal. If the game is being transported for a significant amount of time in an inadequate ambient temperature then the meat could spoil without adequate temporary cold storage. Hunters transport the game to many places for various reasons and often for very long distances. Many hunters prefer to transport their game animal whole from the hunting area to the area where they live in order to get the meat processed close to home. Others would like to transport the game animal from a storage facility to a meat processor near their home. This creates a problem if they live hours from the hunting area so this necessitates temporary cold storage for the animal using the deer cooler. Many hunters lack either the desire, the physical ability, or else the knowledge to remove the skin and properly dismember the game animal. They could transport the animal whole to a local processor for a relatively short distance without the deer cooler and then pick up the processed meat later and utilize a food and beverage cooler to transport the meat home. This creates a large problem. Now the hunter is required to make an unnecessary and additional trip back to this remote hunting area to pick up their meat weeks later once the processor has finished. This would be extremely inconvenient since so many hunters hunt long distances away from home and would have to spend hours traveling to pick up the processed meat. For other hunters there is a requirement to transport the game animal to a cold storage facility which may be a great distance from the remote area where they camp and hunt.

Current practical implementations, as well as published patent documents, that attempt to address these issues include hard-shelled (e.g., plastic) coolers and soft (e.g., cloth) coolers.

Current hard coolers generally available to a hunter are not constructed to allow the storage of an animal without cutting up the carcass which is difficult and time consuming to perform in a remote deer camp. Hunters currently are being inconvenienced with the requirement to remove the skin and partially dismember/process the animal in the field in order to fit the meat in manageably sized and affordable insulated food and beverage coolers. Doing all this requires a significant amount of work and time and more importantly is inconvenient to the hunter. Certain hard coolers shown in patent documents are likely also to be of questionable marketability as successful existence of such coolers in the marketplace has not been found, and certain of such coolers require considerable work on the game animal prior to storage.

Soft material coolers specifically for deer are available, but they may have many creases, zippers, and folds, etc. where blood and animal hair may accumulate in a single usage, and which could further accumulate, spoil, or foul after multiple uses. Thus, such coolers are cumbersome to handle, difficult to clean, and leak in the hunter's vehicle. It is believed that many, if not most, hunters will not purchase the soft cooler since it also has only one very specific use. Certain soft coolers shown in patent documents are likely also to be expensive or of questionable longevity in their function.

Either of the above approaches can be expensive, and if the hunter has other cold-storage needs then they may be required to purchase one cooler for the hunting game and another for their other needs. The average hunter either cannot afford or would not be willing to spend much more than a few hundred dollars on items like these.

The preferred embodiments seek to improve upon the above drawbacks, as further explored below.

BRIEF SUMMARY OF THE INVENTION

In one preferred embodiment, there is a thermally protective storage cooler. The cooler comprises a plurality of hardened material walls. The cooler also comprises at least one aperture formed in a first wall of the hardened material walls and at least two apertures formed in a second wall of the hardened material walls. In the cooler, the second wall is adjacent the first wall so that each of the at least one aperture and the at least two apertures is for receiving a respective portion of a body of game when a portion of the body of the game is stored in an interior of the cooler.

The preferred embodiments are directed to numerous objects and have various technical advantages, any of which are singularly or cumulatively beneficial, and some of which are listed below.

It is an object of the preferred embodiment cooler to keep the deer (or other game) sufficiently cold, and also while whole, that is, without the need to skin or dismember the animal.

It is an object of the preferred embodiment cooler to have ample space around the body of the deer to place plenty of ice bags or other cooling media such as gel bottles in order to sufficiently cool the deer.

It is an object of the preferred embodiment cooler to keep the hunter's vehicle clean by containing the animal and its blood or melting ice in the hard-shelled container. This is especially important in vehicles that have desirable clean interiors or interior elements (e.g., carpeting, etc.).

It is an object of the preferred embodiment cooler to save the hunter money whereby he may purchase a single cooler that will serve multiple functions, including food and beverage cooling and storage.

It is an object of the preferred embodiment cooler to reduce the chances of a leak as compared to the higher likelihood of a soft cooler, such as when the cooling ice melts and water and blood pool in the bottom of the cooler.

It is an object of the preferred embodiment cooler to provide storage for other thermally-maintainable items during times when game is not stored therein, unlike a soft cooler that is specifically made to cool or transport a deer.

It is an object of the preferred embodiment cooler to facilitate simple and effective cleaning and sanitization of smooth, hard, non-porous surfaces.

It is an object of the preferred embodiment cooler to facilitate temporarily store a deer in camp overnight when temperatures are not cold enough to hang the deer and it is too late or inconvenient to take the animal to a cold storage facility.

It is an object of the preferred embodiment cooler to transport and keep cold an already cold deer from one cold storage location to another cold storage location or to a deer meat processor.

It is an object of the preferred embodiment cooler to transport a game deer in the back of a pickup truck or the like, from the deer camp to the hunter's residence or to a cold storage location or to a deer meat processor.

It is an object of the preferred embodiment cooler to facilitate to help minimize spoilage of deer in general since the cooler gives a hunter additional options during hours where cold storage lockers may not be open for business.

It is an object of the preferred embodiment cooler to protect the deer meat stored therein from varmints with a lid that snaps shut or otherwise is relatively sealed from outside entry once closed.

It is an object of the preferred embodiment cooler to protect the deer meat from dirt and dust in camp or when hauling the deer in the back of a vehicle (e.g., pickup truck).

It is an object of the preferred embodiment cooler to make it easier for hunters to care for their game and create convenience so that hunters decrease the chances of the game spoiling.

It is an object of the preferred embodiment cooler to save time and money in that a hunter does not have to immediately take a game deer to a cold storage facility and pay a storage fee as well as fuel for traveling.

It is an object of the preferred embodiment cooler to allow physically challenged hunters to keep their game deer cool without the need to partially process the animal in camp which takes physical strength and stamina.

It is an object of the preferred embodiment cooler to provide a cooler that is lightweight, manageable in size, and affordable to most hunters.

It is an object of the preferred embodiment cooler to reduce the possibility of cross contamination, which may otherwise arise when some hunters, without adequate storage for their game deer, permit the game deer to be laid in the pool of blood that is often found on the floor of the local cold storage facility. Sometimes pigs, goats, and other animals are mixed in with the deer on the floor of the local "deer locker" in town.

It is an object of the preferred embodiment cooler to provide temporary storage even at a meat processing facility so as to remove a hunter's game deer from the possibility of contact with the game of other less careful hunters.

These and other objects are addressed by the preferred embodiments, as further appreciated from the remaining discussion below.

BRIEF DESCRIPTION OF THE SEVERAL VIEWS OF THE DRAWING

The invention will be described in detail below by referring to the accompanying drawings.

DETAILED DESCRIPTION OF THE INVENTION

Figure 1:
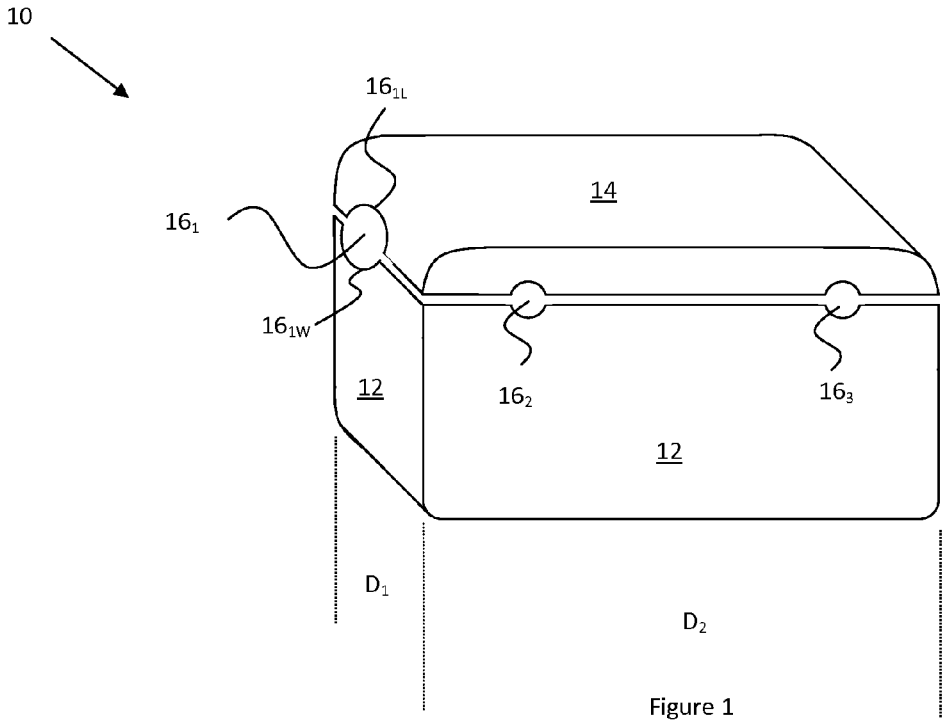
FIG. 1 illustrates a perspective view of a cooler 10 in accordance with a preferred embodiment and having apertures for accommodating portions (e.g., neck and legs) of a game animal.

FIG. 1 illustrates a preferred embodiment, which pertains to a system and method of transporting hunted game, while maintaining the game in a cool environment, such as is often needed in certain (e.g., southern) locations in hunting season. One preferred embodiment includes a hard-shelled cooler 10 for insulating the game, where for sake of example the game is a deer. The cooler 10 is preferably in the range of 120 to 150 quarts in volume and may include various conventional aspects, such as being molded and formed of hard-shelled plastic or otherwise and including insulated walls 12 and an insulated lid 14 connected along one edge to the walls via a hinge (not shown, as on the back side of the perspective shown in FIG. 1). Ice or other cooling mechanisms, such as pre-cooled pack(s), may be introduced into the interior cavity of the cooler 10, after which the insulated walls 12 and the lid 14 will serve, in combination with the cooling mechanism, to maintain the cavity in a relatively cool manner.

As further shown in FIG. 1, the cooler 10 includes a plurality of apertures $\mathbf{16}_1$, $\mathbf{16}_2$, and $\mathbf{16}_3$, so that the central portions of the body of the deer may be located within the interior cavity of the cooler while at least part of the deer (e.g., legs, neck, and head) extends to the cooler exterior, via a respective aperture. In this manner, the cooler 10 may store the deer in its whole natural form and such that the majority of the deer body and is kept at a desirable temperature, where it is not necessary to remove the skin or otherwise dismember the animal prior to placing it in the deer cooler. In a preferred embodiment, each aperture $\mathbf{16}_1$, $\mathbf{16}_2$, and $\mathbf{16}_3$ is formed by one or more recesses along an edge of the conventional wall 12 and/or the lid 14 of the cooler 10. For example, aperture $\mathbf{16}_1$ provides an aperture through which the neck of the deer may pass, thereby maintaining the central body of the deer inside the cooler 10 while a portion of the neck extends through aperture $\mathbf{16}_1$ and the deer head resides external from the cooler 10. Neck aperture $\mathbf{16}_1$ is preferably formed by two recess areas $\mathbf{16}_1$, and $\mathbf{16}_{1L}$. Each recess area $\mathbf{16}_{1W}$ and $\mathbf{16}_{1L}$ is formed as a semicircular or curved recess cutout formed from a respective edge of either the cooler wall 12, the cooler lid 14, or as shown in FIG. 1, both the cooler wall 12 and the cooler lid 14. For example, the recess area $\mathbf{16}_1$, is preferably formed in one of the cooler's end walls, that is, a wall having a shorter dimension $D_1$ as compared to the dimension $D_2$ defining the cooler length. The recess area $\mathbf{16}_{1L}$ is formed at the lower edge of lid 14 and immediately above recess area $\mathbf{16}_{1W}$, thereby combining with the area $\mathbf{16}_1$, to create the aperture $\mathbf{16}_1$. Note also that recess area $\mathbf{16}_{1W}$ (and $\mathbf{16}_{1L}$) is preferably not centered along the cooler end wall (i.e., along the dimension $D_1$), but instead is oriented toward one end of the wall, and preferably the hinge side of the cooler 10, so as to accommodate the location of the deer's neck when the deer's core body is laid within the interior of the cooler 10. The preferred cooler 10 also includes leg apertures $\mathbf{16}_2$ and $\mathbf{16}_3$, formed along another wall 12 that is preferably adjacent the wall 12 that includes the aperture $\mathbf{16}_1$, where in the example of FIG. 1 such adjacent wall is along dimension $D_2$ and each such aperture $\mathbf{16}_2$ and $\mathbf{16}_3$ may accommodate one or a pair of legs of the deer, when the abdomen and chest portions of the deer body are located inside the cooler 10; it is anticipated that typically the deer will be laid within the cooler interior cavity on the deer's side, whereby the deer's front legs align with the aperture $\mathbf{16}_2$ and the deer's rear legs align with the aperture $\mathbf{16}_3$. Each of the leg apertures $\mathbf{16}_2$ and $\mathbf{16}_3$ is also preferably formed of two recesses, akin to the neck aperture $\mathbf{16}_1$, that is, with a curved recess downward from a top wall edge and a corresponding and aligned upward curved recess, located above, the downward curve, but extending upward from the lower edge of the lid 14.

While FIG. 1 illustrates a first neck aperture $\mathbf{16}_1$ at one end wall of the cooler 10, the preferred embodiment preferably also includes a second neck aperture (not expressly visible in the perspective of FIG. 1) along the opposing end wall of the cooler 10, where the second neck aperture has a different dimension than the first. As a result, the same cooler 10 in a first instance may accommodate game having a neck size best fitted by the first neck aperture $\mathbf{16}_1$, while in a second instance accommodating game having a neck size best fitted by the second neck aperture. For example, the first instance game may be a deer buck and the second instance, a deer doe. In this regard, the preferred cooler 10 includes a total of four (4) apertures, preferably along the upper edge of its walls 12. A first aperture $\mathbf{16}_1$, preferably located along the upper edge of one of the shorter walls 12 along dimension $D_1$, is for accommodating the neck of a larger game animal and is approximately 6 to 8" diameter or has an area in the range of 28.28 to 50.27 square inches. A second aperture (not shown), preferably located along the upper edge of the shorter wall 12 opposite the wall 12 including aperture $\mathbf{16}_1$, and also along dimension $D_1$, is for accommodating the neck of a smaller game animal such as a doe and in one embodiment is approximately 5 to 6" diameter or has an area in the range of 19.63 to 28.28 square inches; or, in an alternative embodiment, the second aperture may be the same size as the first aperture $\mathbf{16}_1$, so, for example, a deer may be oriented in reverse fashion, or two deer may be located in the cooler, with a neck of a first deer in the first aperture and a neck of a second deer in the second aperture. The third and fourth apertures $\mathbf{16}_2$ and $\mathbf{16}_3$, each for accommodating a respective pair of legs (or two respective pairs of legs if two deer are stored), preferably located along the upper edge of one of the longer walls 12 along dimension $D_2$, are preferably approximately 2.5-4 inches in diameter, or with an area in the range of 4.91 to 12.56 square inches.

FIG. 2 again illustrates the cooler 10, but further includes preferred aperture closing apparatus $\mathbf{16}_{C1}$, $\mathbf{16}_{C2}$, and $\mathbf{16}_{C3}$ for each of the respective apertures $\mathbf{16}_1$, $\mathbf{16}_2$, and $\mathbf{16}_3$. For sake of illustration in FIG. 2, each of the apertures $\mathbf{16}_1$, $\mathbf{16}_2$, and $\mathbf{16}_3$ is shown in dotted lines to appreciate that it is closed or covered by a respective closing apparatus $\mathbf{16}_{C1}$, $\mathbf{16}_{C2}$, and $\mathbf{16}_{C3}$. The various closing apparatus are detailed below, but it should be appreciated that the functionally they achieve is the closure of apertures $\mathbf{16}_1$, $\mathbf{16}_2$, and $\mathbf{16}_3$, so that when game is not included in the cooler cavity each aperture $\mathbf{16}_1$, $\mathbf{16}_2$, and $\mathbf{16}_3$ may be temporarily closed and the cooler 10 thusly may be used in the more conventional manner of storing items that fit completely within the interior.

Each closing apparatus $\mathbf{16}_{C1}$, $\mathbf{16}_{C2}$, and $\mathbf{16}_{C3}$ is preferably a circular (or other like or comparably shaped) piece that will snap fit into one or both recesses that define the corresponding aperture. For example, closing apparatus $\mathbf{16}_{C1}$ may be two semi-circular pieces, one that will snap fit into the recess $\mathbf{16}_1$, and one that that will snap fit into the recess $\mathbf{16}_{1L}$. As another example, each closing apparatus $\mathbf{16}_{C1}$, $\mathbf{16}_{C2}$, and $\mathbf{16}_{C3}$ is preferably a single circular piece that will snap fit in a generally vertical fashion into one or the other recess when the lid 14 is open, and then fit within the other recess as the lid 14 is closed. As still another example, each closing apparatus $\mathbf{16}_{C1}$, $\mathbf{16}_{C2}$, and $\mathbf{16}_{C3}$ may be some type of plug device that may be snapped into a respective aperture after the lid 14 is closed.

Figure 3:
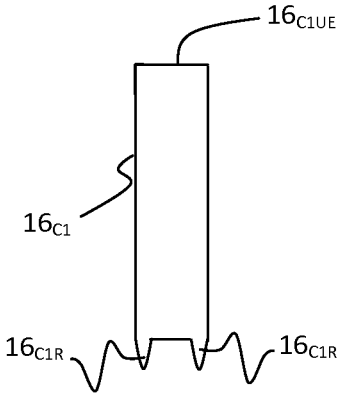
FIG. 3 illustrates a cross section of an aperture closing apparatus.
Figure 4:
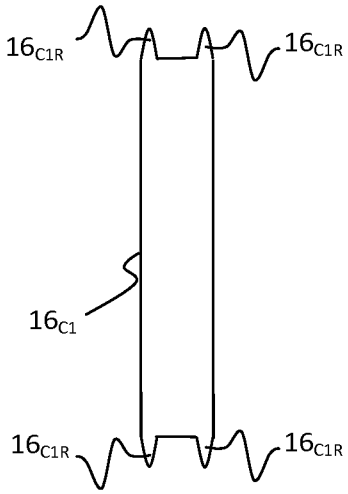
FIG. 4 illustrates a cross section of an alternative aperture closing apparatus.
Figure 5:
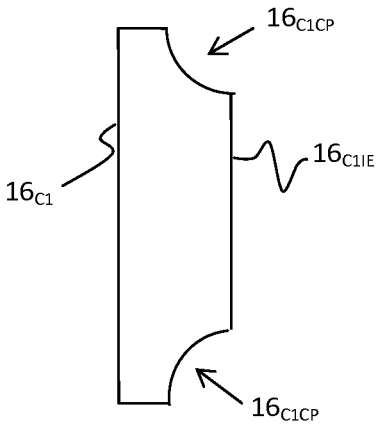
FIG. 5 illustrates a cross section of yet another alternative aperture closing apparatus.

The snap-fit relationship of each closing apparatus $\mathbf{16}_{C1}$, $\mathbf{16}_{C2}$, and $\mathbf{16}_{C3}$ with its respective aperture may be created in various forms. For example, in one approach, each closing apparatus has a center area with a complementary shape to fill the recess to which it corresponds and a snap-fit mating edge for attaching to the cooler wall 12 or lid 14, and this may be achieved with two pieces to form a closing apparatus, one for the lower portion of the aperture in the wall 12 and one for the upper portion of the aperture in the lid 14. For example, therefore, FIG. 3 illustrates a cross-sectional side view of the lower portion of the closing apparatus $\mathbf{16}_{C1}$, depicting lower ridges $\mathbf{16}_{C1R}$ that will fit around the outer edges of the wall 12 when the closing apparatus $\mathbf{16}_{C1}$ is snap fit into the recess $\mathbf{16}_{1W}$, while at the same time the upper edge $\mathbf{16}_{C1UE}$ aligns with the upper edge of the wall 12. As another example, FIG. 4 illustrates a cross-sectional side view of the closing apparatus $\mathbf{16}_{C1}$, which has at both its lower edge, and its upper edge, ridges $\mathbf{16}_{C1R}$; thus, the lower ridges that will fit around the outer edges of the wall 12 when the closing apparatus $\mathbf{16}_{C1}$ is snap fit into the recess $\mathbf{16}_{1W}$, while at the same time the upper ridges will fit around the outer edges of the lid 14 when that lid is closed for the cooler 10. As another example, FIG. 5 illustrates a cross-sectional side view of the closing apparatus $\mathbf{16}_{C1}$, which has an inner edge $\mathbf{16}_{C1IE}$ that, after the lid 14 is closed, is pushed into a respective aperture after which its curved portions $\mathbf{16}_{C1CP}$ align with portions of the cooler wall 12 and lid 14. Other snap-fit relationships, as may be ascertained by one skilled in the art, may be achieved for each recess and its corresponding closing apparatus. Lastly, note also that other closing apparatus may be used, including for example a pliable collar material around the perimeter of each aperture such as extending inward from the aperture recess. This alternative apparatus is preferably sufficiently flexible to yield when the deer (or other game) is located in the cooler interior but then rebounds to a relatively closed area for the aperture when the deer is removed.

The preferred cooler 10 also includes apparatus for storing the closing apparatus $\mathbf{16}_{C1}$, $\mathbf{16}_{C2}$, and $\mathbf{16}_{C3}$ (and others) when such apparatus are removed from their respective recesses, so that such apparatus are not easily misplaced or lost. Thus, in one approach each closing apparatus may be attached to the molded body of the cooler 10 at a location, other than its respective recess, while storing or transporting the game. For example, one potential alternative storing location is the underside of the lid 14, or another such location is outside of the cooler 10 to an exterior surface thereof. As another example, each closing apparatus $\mathbf{16}_{C1}$, $\mathbf{16}_{C2}$, and $\mathbf{16}_{C3}$ may have a flexible strap attached to it whereby it is strapped to either the interior or exterior of the cooler 10 while not located in its respective aperture.

Figure 6:
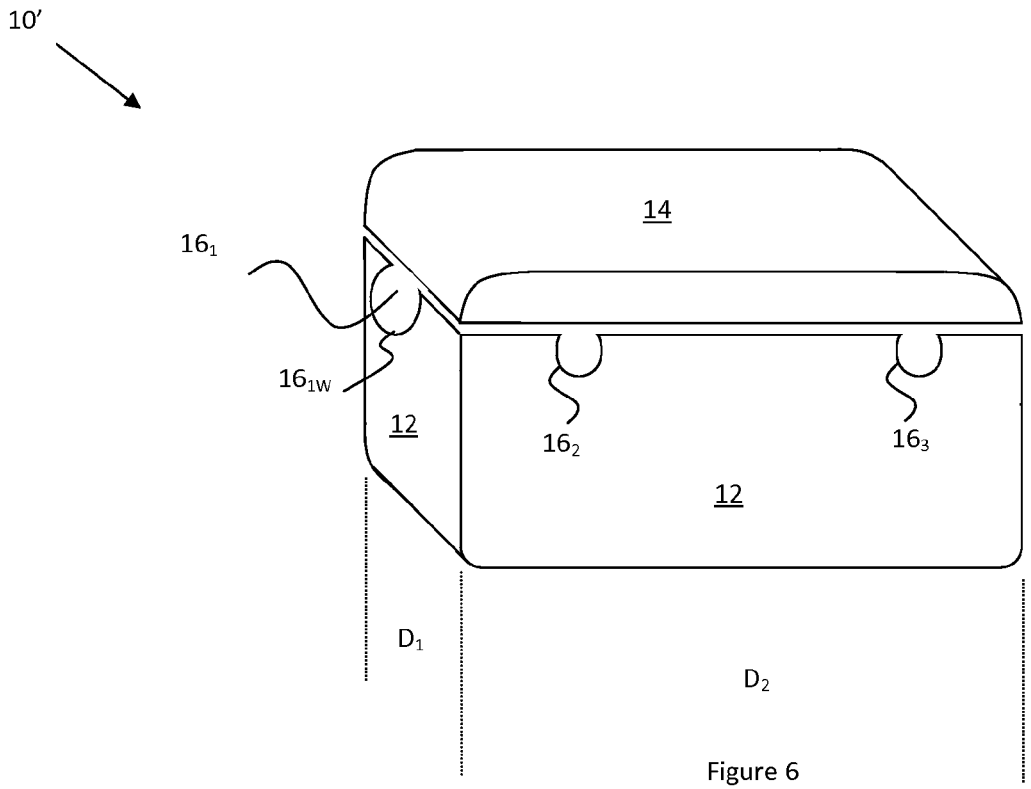
FIG. 6 illustrates a perspective view of an alternative cooler 10' in accordance with a preferred embodiment, again with apertures for accommodating portions (e.g., neck and legs) of a game animal, but wherein the apertures are located in walls of the cooler and not within its lid.

FIG. 6 illustrates an alternative preferred embodiment cooler 10, which again includes three illustrated apertures $16_1$, $16_2$, and $16_3$ (and potentially a fourth in the wall 12 opposite aperture $16_1$ but not visible in the perspective). In the cooler 10', however, note that each aperture is preferably located only along a wall, and thus the cutaway forming the aperture does not extend into the lid 14. This approach may be favorable for manufacturability and may also facilitate better or more efficient seals with respective aperture closing apparatus.

Figure 2:
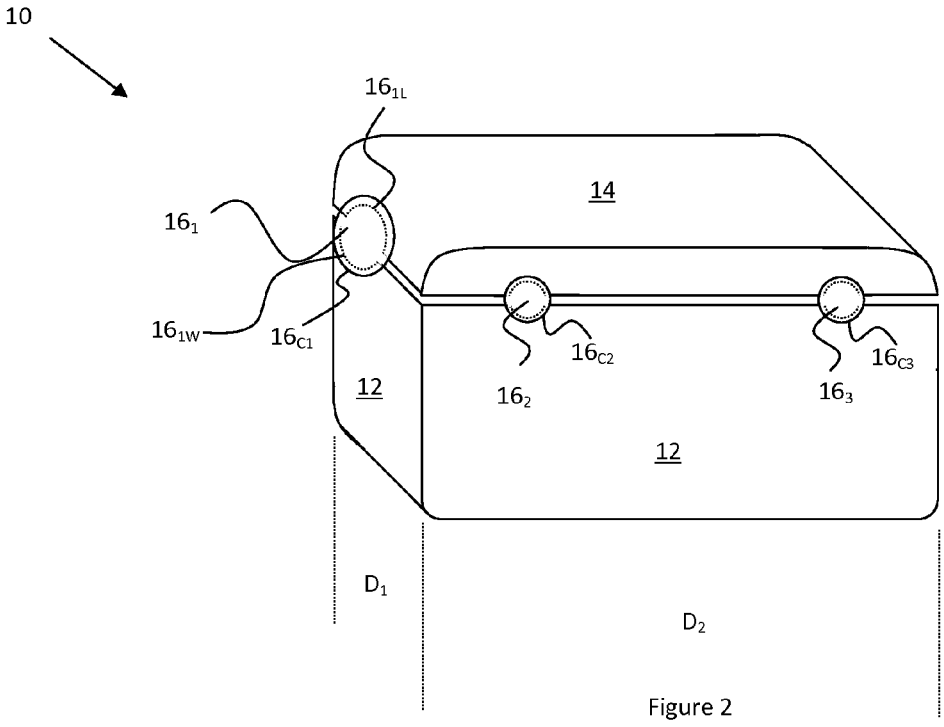
FIG. 2 illustrates the cooler of FIG. 1 and with aperture closing apparatus in the apertures of FIG. 1.
Figure 7A:
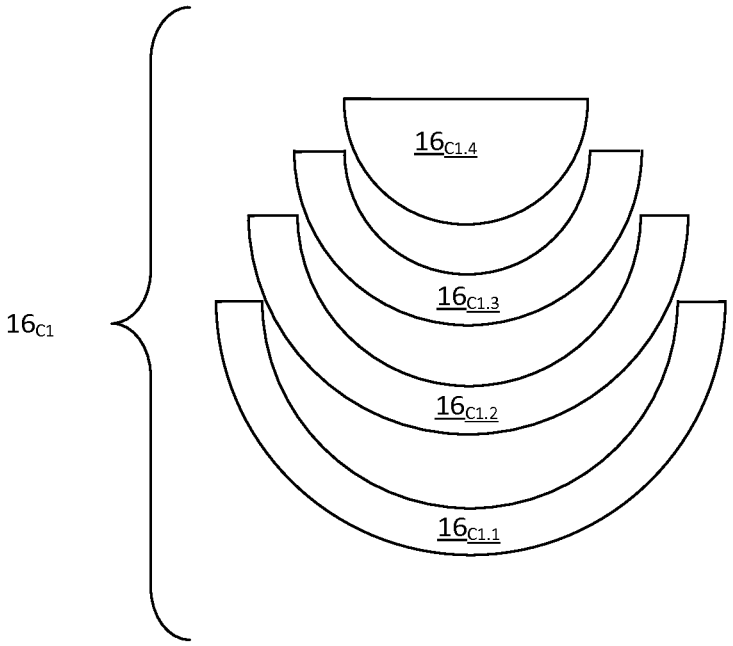
FIGS. 7*a* through 7*f* illustrate an alternative preferred aperture closing apparatus $\mathbf{16}_{C1}$, as may be used with the cooler 10' of FIG. 6, or as may be further modified by one skilled in the art per the teachings of this document for use with the cooler 10 of FIGS. 1-2.
Figure 7B:
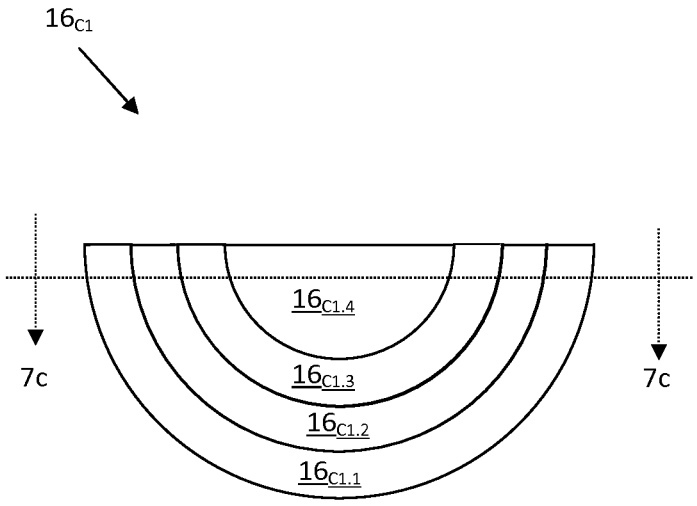
Figure 7C:
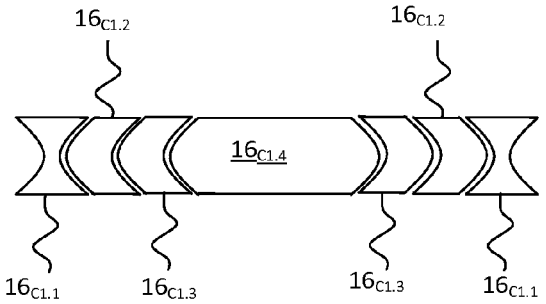

FIGS. 7*a* through 7*f* illustrate an alternative preferred aperture closing apparatus $16_{C1}$, as may be used with the cooler 10' of FIG. 6, or as may be further modified by one skilled in the art per the teachings of this document for use with the cooler 10 of FIGS. 1-2. Looking first to FIG. 7*a*, it illustrates an exploded view of the closing apparatus $16_{C1}$, which includes four (or some other plural number) related pieces $16_{C1.1}$ through $16_{C1.4}$, where each such piece is mateable, preferably in a snap-fit or other mating (i.e., aligning) and retaining relationship, with at least one other piece as will be further appreciated below. Each of the pieces $16_{C1.1}$ through $16_{C1.4}$ is shaped to accomplish the mating relationship described in this document, so in the example where aperture $16_1$ is circular, then preferably each piece has generally a circular inner and outer edge; one skilled in the art, however, could adjust the shape to other shapes (e.g., portion of an oval) so as to accommodate a different aperture $16_1$ or to accommodate the anticipated neck shape of the animal to be stored within the cooler 10' or 10. In any event, to further illustrate the mating of each of the pieces $16_{C1.1}$ through $16_{C1.4}$, FIG. 7*c* illustrates a cross-sectional top-down view of each such piece. First, note that piece $16_{C1.1}$ is contoured on its outer perimeter to align with the wall 12 of the cooler 10', as may be comparable to the embodiments of FIGS. 3 and 4. Moreover, and as shown in FIGS. 7*b* and 7*c*, piece $16_{C1.2}$ snap fits its outer ridge to the inner ridge of piece $16_{C1.1}$, piece $16_{C1.3}$ snap fits its outer ridge to the inner ridge of piece $16_{C1.2}$, and piece $16_{C1.4}$ snap fits its outer ridge to the inner ridge of piece $16_{C1.3}$. In this manner, therefore, when all pieces are assembled together, a semi-circular result is provided as the closing apparatus $16_{C1}$, for use in the aperture $16_1$ of cooler 10' (or, as modified, for the aperture $16_1$ of cooler 10).

Figure 7D:
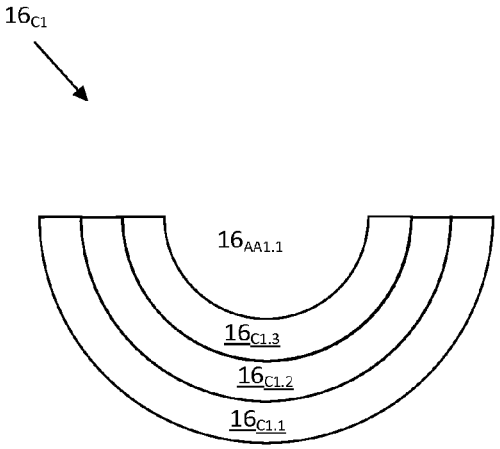
Figure 7E:
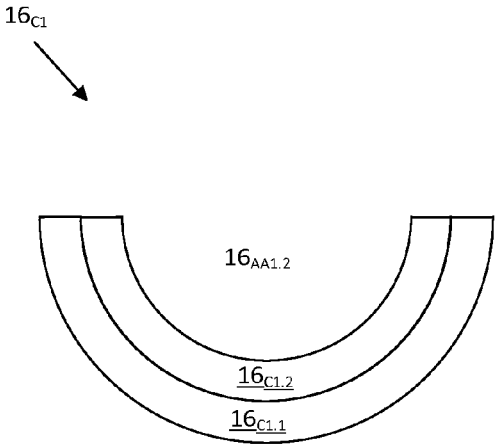
Figure 7F:
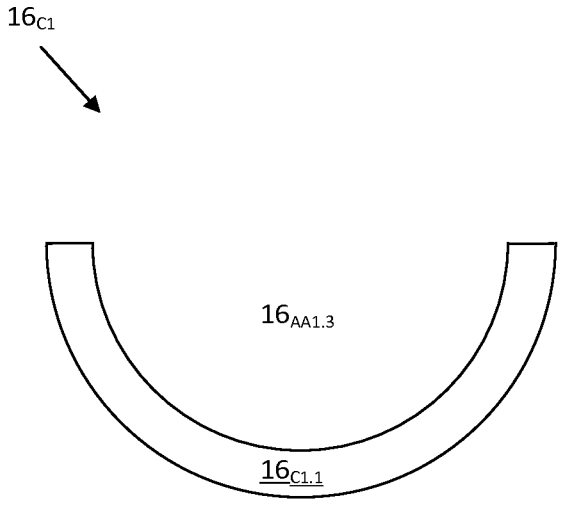

In another aspect of the preferred embodiments, and given the mating relationship of the pieces $16_{C1.1}$ through $16_{C1.4}$ with one another and to the wall 12 of the cooler 10', FIGS. 7*d*, 7*e*, and 7*f* further illustrate that one or more pieces of the closing apparatus $16_{C1}$, may be removed, starting from the center piece $16_{C1.4}$ and radially outward, so as to provide an aperture that is smaller than aperture $16_1$. In FIG. 7*d*, for example, the center piece $16_{C1.4}$ is removed from the closing apparatus $16_{C1}$ of FIG. 7*b*, thereby producing an aperture area $16_{AA1.1}$ in which an animal neck may be positioned. In FIG. 7*e*, both the center piece $16_{C1.4}$ and the next smaller radius piece $16_{C1.3}$ are removed from the closing apparatus $16_{C1}$ of FIG. 7*b*, thereby producing an aperture area $16_{AA1.2}$ in which an animal neck may be positioned, where notably the aperture area $16_{AA1.2}$ of FIG. 7*e* is larger than the aperture area $16_{AA1.1}$ of FIG. 7*d*, but the same resulting aperture area $16_{AA1.2}$ of FIG. 7*e* is still smaller than aperture $16_1$, that is, where the entire closing apparatus $16_{C1}$ is removed. As a final example, in FIG. 7*f*, all three of the center pieces $16_{C1.4}$, $16_{C1.3}$, and $16_{C1.4}$ are removed from the closing apparatus $16_{C1}$ of FIG. 7*b*, thereby producing an aperture area $16_{AA1.3}$ in which an animal neck may be positioned, where the aperture area $16_{AA1.3}$ of FIG. 7*f* is larger than either the aperture area $16_{AA1.1}$ of FIG. 7*d* or the aperture area $16_{AA1.2}$ of FIG. 7*e*, and again the same resulting aperture area $16_{AA1.3}$ of FIG. 7*e* is still smaller than aperture $16_1$, that is, where the entire closing apparatus $16_{C1}$ is removed.

Given the preceding discussion of FIGS. 7*a*-7*f*, one skilled in the art should appreciate that either the entire closing apparatus $16_{C1}$ may be removed to provide an area of the aperture $16_1$ for a neck of the animal, or portions of the closing apparatus $16_{C1}$ may remain in aperture $16_1$, thereby providing a respective smaller aperture area for various different (i.e., smaller) animal necks, as compared to the area provided by aperture $16_1$. Moreover, recall an earlier embodiment includes a first aperture $16_1$ located along the upper edge of one of the shorter walls 12 along dimension $D_1$, with a second comparable, but different diameter aperture (not shown), located along the upper edge of the shorter wall 12 opposite the wall 12 including aperture $16_1$. With the embodiment of FIGS. 7*a*-7*f*, however, one of these two apertures may be eliminated, as a single aperture $16_1$ on one cooler end wall will suffice, with its area being adjustable by removing one or more of the plurality of fitting pieces. In addition, note that the inventive concepts described in connection with a multi-piece closing apparatus $16_{C1}$ for aperture $16_1$ also may be applied, albeit with different dimensions, for the apertures $16_2$ and $16_3$ in the longer wall 12 of cooler 10' or 10.

Any of the preferred embodiments also may include other preferred aspects. For example, a preferred embodiment cooler may include a surface treatment along the interior bottom of the cooler, such as a ribbed surface, so as to keep the deer from laying in melted ice water and/or blood. As another example, a preferred embodiment cooler preferably includes a drain near the bottom.

Given the preceding, the preferred embodiments provide improved coolers including an insulated cooler for alternatively storing hunting game, such as in substantially or fully whole form, while alternatively functioning to store items comparable to that of an ordinary cooler. These embodiments provide numerous benefits over the prior art, some of which are described above and others of which may be ascertained by one skilled in the art. For example, the preferred embodiment cooler is a dual use hard cooler that is easy to clean, does not leak, and when not storing game can be used a large food and beverage cooler so the hunter gets plenty of value from it. As another example, the preferred embodiment cooler provides a means of cooling and preserving a whole game animal during temporary storage of the animal in deer camp as well as during transportation of the animal from the hunt to the meat processor or the hunter's home. As still another example, the preferred embodiment cooler provides convenient, affordable, and simple to use temporary cold storage for whole game animals such as whitetail deer when the temperatures during hunting season are too high to keep meat from spoiling. As still another example, the preferred embodiment cooler provides a quick, easy, and convenient method to store the game animal whole and keep it cold without the need for skinning, dismembering, or processing the animal in the field. As a final example, the preferred embodiment cooler accommodates the unique shape and size of whole game animals similar to that of whitetail deer, whereas until now it has not been possible store these game animals whole in a hard insulated container that is manageable in size as well as affordable to most hunters. As another example, the preferred embodiment cooler can be used to transport a whole deer from the field to a cold storage facility, from a cold storage facility to the hunter's residence, or from a cold storage facility to the preferred location of processing. Further, while the inventive scope has been demonstrated by certain preferred embodiments, one skilled in the art will appreciate that it is further subject to various modifications, substitutions, or alterations, without departing from that inventive scope. For example, while certain dimensions and shapes have been provided, alternatives may be selected. Thus, the inventive scope is demonstrated by the teachings herein and is further guided by the following exemplary but non-exhaustive claims.

What is claimed is:

1. A thermally protective storage cooler having an interior cavity, comprising:

a plurality of hardened thermally-insulating material walls for maintaining the interior cavity relatively cool compared to a temperature exterior to the cooler;

at least one aperture formed in a first wall of the hardened thermally-insulating material walls;

at least two apertures formed in a second wall of the hardened thermally-insulating material walls, wherein the second wall is adjacent the first wall; and wherein each of the at least one aperture and the at least two apertures has a respective area at least large enough, and is, for receiving a respective portion of a body of game when a first portion of the body of the game is stored in the interior cavity of the cooler; and wherein, when the first portion of the body of the game is stored in the interior cavity, a second portion of the body of the game extends through the at least one aperture formed in the first wall, for maintaining the interior cavity relatively cool compared to a temperature exterior to the cooler;

a third portion of the body of the game extends through a first of the least two apertures formed in the second wall, for maintaining the interior cavity relatively cool compared to a temperature exterior to the cooler; and a fourth portion of the body of the game extends through a second of the least two apertures formed in the second wall, for maintaining the interior cavity relatively cool compared to a temperature exterior to the cooler.

2. The cooler of claim 1 wherein the at least one aperture formed in a first wall has an area of at least about 19 square inches.

3. The cooler of claim 1 wherein the at least one aperture formed in a first wall has a dimension of at least about 5 inches.

4. The cooler of claim 1 wherein each of the at least two apertures formed in the second wall has a respective area large enough, and is, for receiving a leg of the body of game.

5. The cooler of claim 1 wherein the game is a deer.

6. The cooler of claim 1 wherein the at least one aperture formed in a first wall is formed along an upper edge of the first wall.

7. The cooler of claim 6 wherein each of the at least two apertures formed in a second wall is formed along an upper edge of the second wall.

8. The cooler of claim 1 and further comprising:

a third wall of the hardened material walls, located adjacent the second wall and opposite the first wall; and at least one aperture formed in the third wall; and wherein the aperture formed in the third wall has a different aperture area than the at least one aperture formed in the first wall.

9. The cooler of claim 8:

wherein the at least one aperture formed in the first wall has an area large enough, and is, for receiving a neck of a first game animal, the neck of the first game animal having a first size; and wherein the at least one aperture formed in the third wall has an area large enough, and is, for receiving a neck of a second game animal, the neck of the second game animal having a second size, different from the first size.

10. The cooler of claim 9:

wherein the at least one aperture formed in the first wall has a dimension of at least 6 inches; and wherein the at least one aperture formed in the third wall has a dimension of at least 5 inches.

11. The cooler of claim 9:

wherein the at least one aperture formed in a first wall is formed along an interface of the first wall and a lid for the cooler; and wherein each of the at least two apertures formed in a second wall is formed along an interface of the second wall and the lid for the cooler.

12. The cooler of claim 1 and further comprising a plurality of closure members for insertion into respective ones of the at least one aperture and the at least two apertures.

13. The cooler of claim 12 wherein each closure member in the plurality of closure members consists of a single piece.

14. The cooler of claim 12 wherein each closure member in the plurality of closure members comprises a plurality of pieces.

15. The cooler of claim 12 and further comprising means for attaching at least one of the closure members to the cooler at a location other than a respective aperture.

16. The cooler of claim 12 wherein each closure member in the plurality of closure members comprises means mateable to a respective one of the at least one aperture.

17. A thermally protective storage cooler, comprising:

a plurality of hardened material walls;

at least one aperture formed in a first wall of the hardened material walls, the at least one aperture having an aperture area;

at least two apertures formed in a second wall of the hardened material walls, wherein the second wall is adjacent the first wall; and wherein each of the at least one aperture and the at least two apertures has a respective area at least large enough, and is, for receiving a respective portion of a body of game when a portion of the body of the game is stored in an interior of the cooler;

and further comprising a closure member for insertion into the at least one aperture, the closure member comprising a plurality of mateable members and wherein each mateable member may be removed from the plurality of mateable members so as to leave a remaining one or more of the mateable members affixed in the aperture area to thereby reduce the aperture area.

* * * * *